US006681581B2

(12) United States Patent
Cassell et al.

(10) Patent No.: US 6,681,581 B2
(45) Date of Patent: Jan. 27, 2004

(54) PRE-CONDITIONED SOLUTE FOR USE IN CRYOGENIC PROCESSES

(75) Inventors: Allan J. Cassell, West Heidelberg (AU); Brian Wood, Lubbock, TX (US)

(73) Assignee: Supachill Technologies Pty. Ltd., West Heidelberg (AU)

( * ) Notice: Subject to any disclaimer, the term of this patent is extended or adjusted under 35 U.S.C. 154(b) by 20 days.

(21) Appl. No.: 09/989,738

(22) Filed: Nov. 20, 2001

(65) Prior Publication Data

US 2003/0094003 A1 May 22, 2003

(51) Int. Cl.[7] ..... F25C 1/24
(52) U.S. Cl. ..... 62/76; 62/114; 62/434
(58) Field of Search ..... 62/76, 72, 434, 62/114

(56) References Cited

U.S. PATENT DOCUMENTS

| | | | | |
|---|---|---|---|---|
| 3,412,476 A | | 11/1968 | Astrom | |
| 3,653,494 A | | 4/1972 | Miller | 198/195 |
| 3,866,432 A | | 2/1975 | Harrison | 62/208 |
| 4,167,101 A | * | 9/1979 | Rojey | 62/102 |
| 4,311,019 A | * | 1/1982 | Rojey et al. | 62/101 |
| 4,341,084 A | * | 7/1982 | Rojey et al. | 62/101 |
| 4,429,542 A | | 2/1984 | Sakao et al. | |
| 4,480,445 A | * | 11/1984 | Goldstein | 62/434 |
| 4,554,797 A | * | 11/1985 | Goldstein | 62/434 |
| 4,619,257 A | | 10/1986 | Linner et al. | |
| 4,647,543 A | | 3/1987 | Stocker | |
| 4,676,070 A | | 6/1987 | Linner | |
| 4,848,094 A | | 7/1989 | Davis et al. | 62/64 |
| 4,888,956 A | | 12/1989 | le Roux Murray | |
| 4,901,844 A | | 2/1990 | Palmaer et al. | 198/778 |
| 4,971,842 A | | 11/1990 | Sippola | 427/433 |
| 4,985,169 A | * | 1/1991 | Rolland et al. | 252/69 |
| 5,003,787 A | | 4/1991 | Zlobinsky | 62/185 |
| 5,022,236 A | | 6/1991 | Knippscheer et al. | 62/529 |
| 5,191,773 A | | 3/1993 | Cassell | 62/373 |
| 5,222,367 A | | 6/1993 | Yamada | |
| 5,328,821 A | | 7/1994 | Fisher et al. | 435/240 |
| 5,496,456 A | | 3/1996 | Fischer et al. | 204/201 |
| 5,560,956 A | | 10/1996 | Schmehl | 427/2.11 |
| 5,638,686 A | | 6/1997 | Coelho et al. | 62/51.1 |
| 5,860,282 A | | 1/1999 | Liberman et al. | 62/63 |
| 5,873,254 A | | 2/1999 | Arav | 62/63 |
| 5,891,617 A | | 4/1999 | Watson et al. | |
| 6,140,123 A | | 10/2000 | Demetriou et al. | |

FOREIGN PATENT DOCUMENTS

| | | | |
|---|---|---|---|
| AU | 2120099 | 9/1999 | |
| DE | 12 38 618 B | 4/1967 | |
| EP | 0 174 170 | 3/1986 | F25D/17/02 |
| EP | 0 331 296 A1 | 9/1989 | A23B/7/144 |
| GB | 765760 | 1/1957 | |
| GB | 999377 | 7/1965 | |
| JP | 63 273776 | 11/1988 | F25D/13/06 |
| JP | 64000219 | 5/1989 | C21D/1/18 |
| WO | WO 91/02202 | 2/1991 | F25D/23/02 |
| WO | WO 97/35155 | 9/1997 | F25D/31/00 |

* cited by examiner

*Primary Examiner*—Melvin Jones
(74) *Attorney, Agent, or Firm*—Raymond M. Galasso; Simon, Galasso & Frantz PLC

(57) ABSTRACT

Embodiments of the present invention disclose methods for producing pre-conditioned solutes that exhibit no temperature spike during super-cooling in a cryogenic process. In addition, the solutes demonstrate utile capabilities and characteristics such as more efficient heat absorption rates and eutectic material properties which make the preconditioned solutes an efficient heat exchange medium. The methods involve super-cooling a solute to induce a long-duration phase change capability. The pre-conditioned solute may be thawed and will retain long-duration phase change capabilities for subsequent freezing cycles if the freezing protocols disclosed herein are followed. Material to be frozen may be directly immersed into pre-conditioned, super-cooled solutes for freezing. The solute may be propylene glycol, glycerol, or other suitable solutes.

10 Claims, 4 Drawing Sheets

PRE-CONDITIONED SOLUTE FOR USE IN CRYOGENIC PROCESSES

FIELD OF THE INVENTION

The present invention relates generally to cryogenic preservation, and more particularly to heat exchange media used in cryopreservation.

BACKGROUND OF THE INVENTION

Cryopreservation refers to all stages of preservation: treatment, freezing, storage, and thawing processes. Considerable research efforts have been devoted to developing cryoprotective substances, as well as to optimization of freezing and thawing temperatures and cooling rates for various cell types and materials. Other sectors of this research effort have focused on heat transfer compounds and heat transfer mechanisms within the temperature domain of cryogenic preservation.

Heat transfer processes move thermal energy to or from an object in physical contact with a heat transfer fluid which is either at a temperature hotter or colder than the object. Various organic fluids have been used as such heat transfer fluids for high temperature (non-cryogenic) heat transfer processes. In the low temperature domain of cryogenics, low molecular weight alcohols, ketones and halogenated hydrocarbons have been used for low temperature heat transfer processes.

Low temperature heat transfer processes continue to have difficulties caused by the volatility, toxicity, flammability, foaming, or low temperature viscosity changes of conventional low temperature organic heat transfer fluids. Some conventional low temperature heat transfer fluids, such as acetone, absorb any moisture they contact. A heat transfer apparatus employing such fluids may thus adversely affect low temperature heat transfer processes. The efficiency of the thermal energy transfer process is also adversely impacted by viscosity increases and gelation of the low temperature heat transfer fluid, as reduced circulation or clogging of parts of the heat transfer apparatus can occur. Additionally, the rate at which these heat transfer fluids absorb heat energy is generally less than optimal.

SUMMARY OF THE INVENTION

Therefore, what is needed is an improvement in heat transfer processes in the cryogenic realm which avoid the problems previously discussed. Accordingly, the various embodiments of the present invention disclose methods for producing a pre-conditioned solute with more efficient heat transfer properties, in addition to other utile capabilities and characteristics in a cryogenic process. For example, the solutes disclosed herein do not exhibit an increase in temperature during a latent heat phase transition when used in a freezing process, or, at the very least, exhibit a reduced increase in temperature.

In an embodiment, a solute is pre-conditioned by being super-cooled from ambient room temperature to about −23 degrees C. very quickly, on the order of at least about 6.5 degrees C. per minute, on average. This rapid chilling of the solute results in a super-cooled solute, which may then be used as a heat exchange medium to absorb heat from substances immersed in the pre-conditioned solute. Super-cooling is cooling a liquid substance below the freezing point without solidification or crystallization taking place. Super-cooling alters a heat absorption rate of the solute such that pre-conditioned solute has an increased heat absorption rate in comparison to solute which has not been pre-conditioned. The heat absorption rate of a pre-conditioned solute according to one embodiment of the present invention is about 135 BTU at a temperature of between about −23 degrees C. and −26 degrees C.

In an embodiment, pre-conditioning a solute includes super-cooling the solute from ambient room temperature to between about −23 degrees C. and −26 degrees C. at an average rate of cooling of between about 6.5 degrees C. and 8.5 degrees C. In a further embodiment, the step of pre-conditioning the solute includes super-cooling the solute, for at least a portion of time, at an average cooling rate of at least about 17 degrees C. per minute.

After super-cooling, a portion of the pre-conditioned solute remains in a super-cooled state after being pre-conditioned as disclosed herein. In this super-cooled state, the heat that normally would be released upon freezing of the solute is decreased, thus the pre-conditioned solute exhibits no spike in temperature upon subsequent cooling from ambient room temperature to between about −23 degrees C. and −26 degrees C. The pre-conditioned solute can be used as the cooling liquid in a system consisting of a tank capable of holding a predetermined amount of liquid, a circulator to circulate the liquid in the tank, and a refrigeration system capable of cooling the liquid within the tank.

An object of at least one embodiment of the present invention is to produce a solute with improved heat absorption properties for use in a cryogenic process.

An advantage of at least one embodiment of the present invention is that the heat absorption rate of pre-conditioned solute is greater than the heat absorption rate as compared to a non-conditioned solute, making the pre-conditioned solute a better heat exchange medium than a non-conditioned solute.

A further advantage of at least one embodiment of the present invention is that freeze damage to sensitive materials is decreased because no temperature spike is observed in a pre-conditioned solute upon subsequent freezing.

BRIEF DESCRIPTION OF THE DRAWINGS

Other objects, advantages, features and characteristics of the present invention, as well as methods, operation and functions of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION OF THE FIGURES

FIGS. 1–4 depict, according to various embodiments of the disclosures herein, a solute, a process for preparation of conditioned solutes, and a process for chilling articles by using such pre-conditioned solutes. Such super-cooled solutes and their associated preparation processes, chilling processes, and articles provide utile capabilities and characteristics. Specifically, the pre-conditioned solutes exhibit a very long-duration phase change capability, maintain liquidity during freezing, possess efficient heat absorption properties, and return to a pre-frozen consistency after being frozen and thawed.

During the freezing process in general, molecules of the constituent chemicals within a solution are forced into alignment. This forced alignment causes the constituent chemicals within the media to produce an endothermic reaction, which releases a final amount of energy during a latent heat phase. As freezing materials undergo the latent heat phase (with attendant endothermic reaction), this released heat causes a momentary increase in the temperature of the solution. This latent heat, also known as heat of transformation, if measured during a phase transition at constant pressure (e.g., melting, boiling, sublimation), is simply the change of enthalpy. The change in enthalpy during an isobaric process is equal to the heat that is transferred when a system undergoes an infinitesimal process from an initial equilibrium state to a final equilibrium state.

In theory, most chemical reactions are bi-directional (reversible). In practice, however, many chemical reactions are found to be uni-directional (irreversible), based upon the energy requirements of a particular reaction. In the case of the solutes as embodied in the present disclosures, the release of heat during a latent heat phase is just such a unidirectional chemical reaction. Once the reactions within the solutes taken place, simply adding back the same amount of heat removed during the cooling cycle does not reverse the reactions. Therefore, once conditioned according to the various embodiments disclosed herein, the solutes exhibit a long-duration phase change capability upon subsequent freezing.

Figure 1:
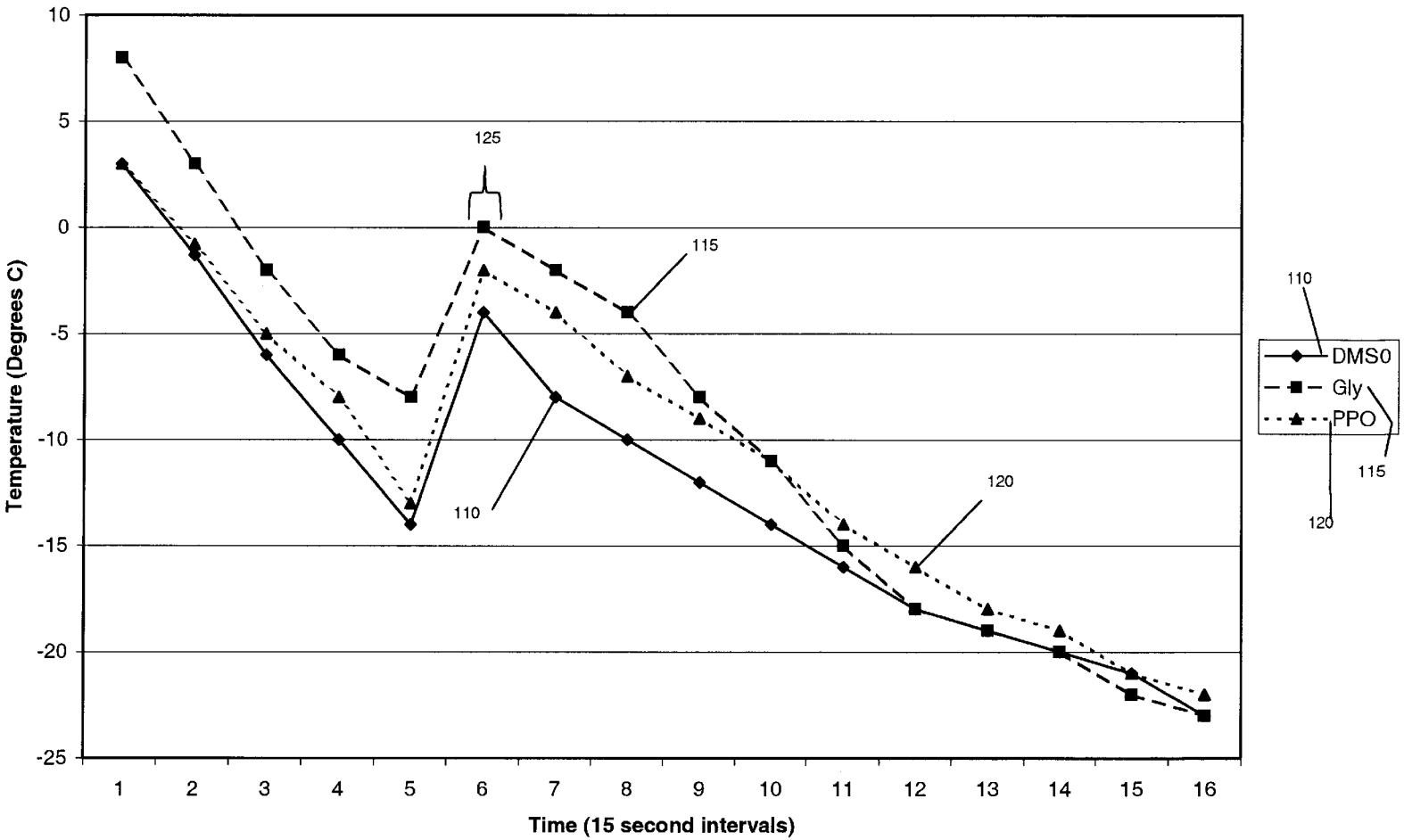
FIG. 1 is a graph of temperature measurements of three cyroprotectants undergoing pre-conditioning by being subjected to rapid cooling over a short time interval according to at least one embodiment of the present invention.

The occurrence of latent heat released during a freezing process is demonstrated in FIG. 1, which is a line graph of the temperature measurements for three solutes undergoing pre-conditioning for use as improved heat-exchange media according to various embodiments of the present invention. The solutes illustrated in FIG. 1 were subjected to rapid cooling over a short time interval in an exemplary cooling apparatus as disclosed herein. The solutes of FIG. 1 include dimethyl sulfoxide, shown as DMSO 110, an egg-yolk/glycerol solution, shown as Gly 115, and propanediol, shown as PPO 120. The effects of the heat of transformation energy released during the cooling process are clearly observed in the measurements between time intervals 5 (at time=75 seconds) and 6 (at time=90 seconds), where a marked increase in temperature, or spike 125, is observed in all three solutes. After spike 125, subsequent measurements at succeeding time intervals exhibit a decrease in temperature to the end of the measurement time period. It should be noted that the solutes illustrated in FIG. 1, when subjected to pre-conditioning by rapid cooling as disclosed herein, exhibit an increase in heat absorption rates over solutes which have not undergone pre-conditioning.

Normally, heat released during a latent heat phase of the solutes causes a momentary rise in temperature in the solute media, as seen in spike 125, during a freezing cycle. This rise in temperature makes unconditioned solutes less-than-ideal heat exchange media. However, if one first rapidly freezes (super-cools) the solute in a pre-conditioning step as disclosed herein, the temperature rise indicated by spike 125 is not observed upon subsequent freezing events because the pre-conditioned solute has undergone a change in its chemical nature which is manifested as a long-duration phase change capability.

In one embodiment, a solute is pre-conditioned to improve its use as a primary heat exchange medium. The solute is pre-conditioned by super-cooling the solute from ambient room temperature to at least about −23 degrees C. at an average rate of cooling of about 6.5 degrees C. per minute. In another embodiment, pre-conditioning includes super-cooling the solute from ambient room temperature to between about −23 degrees C. and −26 degrees C. at an average chill rate of between about 6.5 degrees and 8.5 degrees C. per minute. A further embodiment pre-conditions the solute by super-cooling at an average rate of at least about 17 degrees per minute for at least a portion of time prior to the start of temperature spike 125.

After pre-conditioning as disclosed herein, a solute may be re-used as desired, and maintains its improved heat absorption properties even after being thawed to room temperature. It should be noted that if the solute is pre-conditioned using a rate of freezing that is significantly slower than that disclosed herein, for example by freezing in conventional freezers, etc., the solute may not exhibit a long duration phase change, and temperature spike 125 may be manifested during subsequent freeze cycles, and the improved. In addition, an optimum increased heat absorption rate of the pre-conditioned solute will not be achieved.

Figure 2:
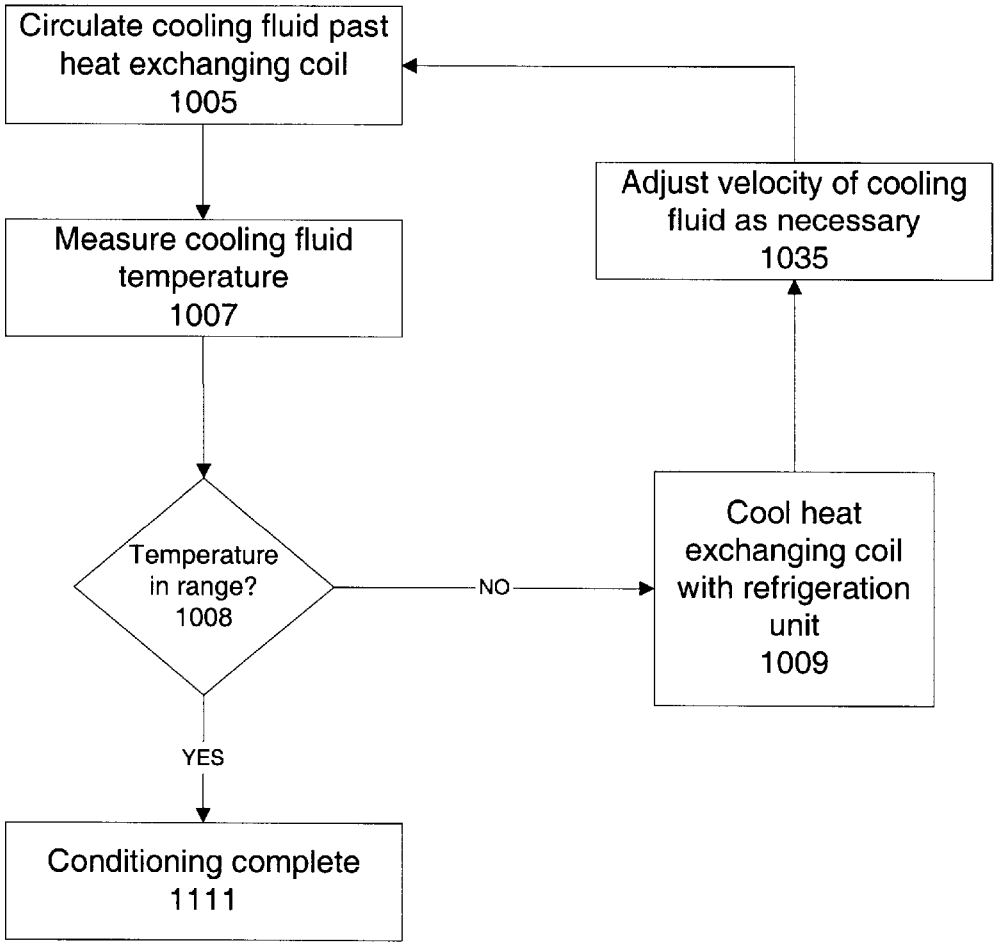
FIG. 2 is a flow diagram illustrating a method for pre-conditioning a solute according to at least one embodiment of the present invention.
Figure 4:
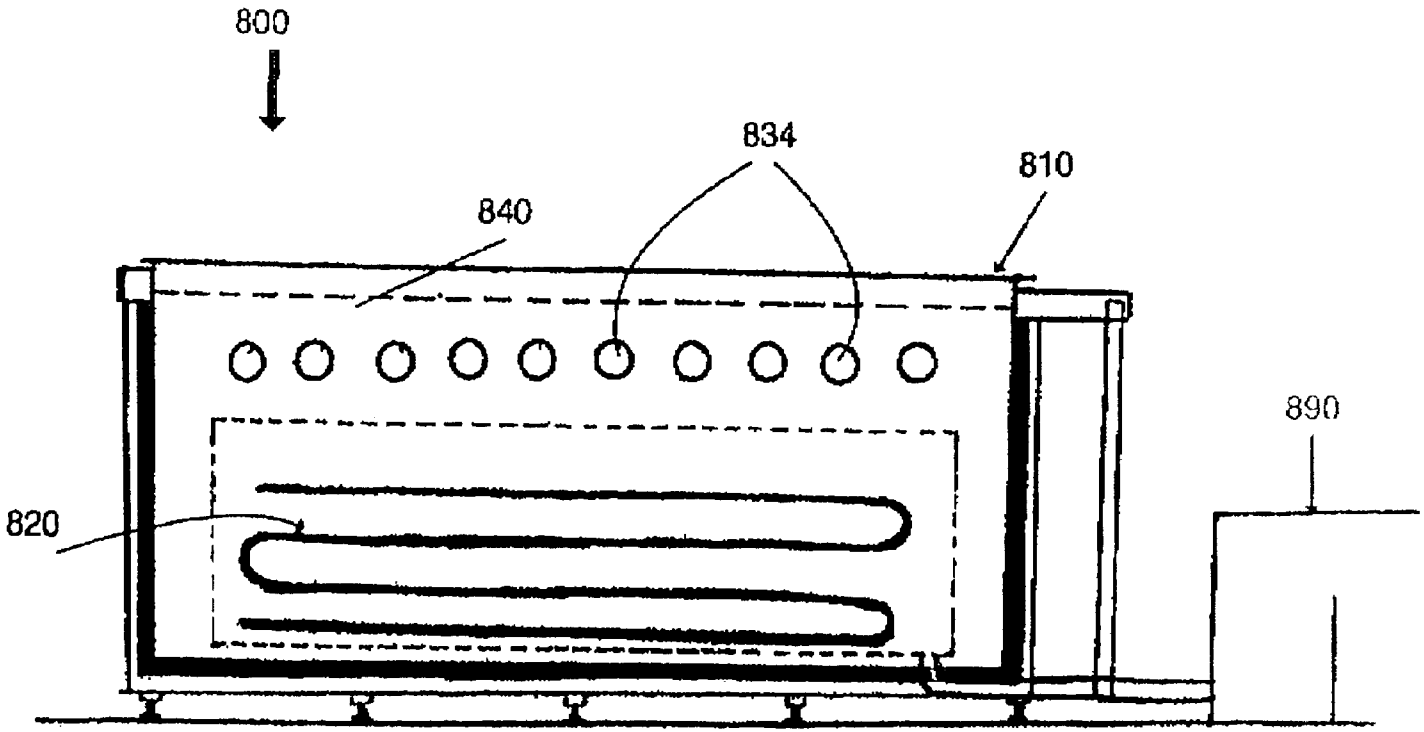
FIG. 4 is a cut-away side view of a chilling apparatus suitable for practicing a method according to at least one embodiment of the present invention.

Referring now to FIG. 2, a flow diagram illustrating a method for pre-conditioning a solute according to at least one embodiment of the present invention. A cooling fluid is introduced into a tank of a chilling apparatus and is circulated past the heal exchanging coil, as in step 1005, to rapidly chill the cooling fluid to induce an irreversible phase change as previously discussed. In one embodiment, the cooling fluid is the solute to be conditioned. The rate of chilling of the solute in the chilling apparatus should average between about 6.5 degrees C. and 8.5 degrees C. per minute. In a further embodiment, the rate of chilling averages at least about 17 degrees C. per minute. A chilling apparatus such as that presented in FIG. 4 is ideal for achieving the chill rates as disclosed herein. The solutes used in the various embodiments may include, but are not limited to, glycerol and propylene glycol. High grade solutes having relatively few impurities are preferred.

In one embodiment, purified propylene glycol and water are blended at ratios of about 50% and about 50%, respectively, by weight, thus forming a super-coolable mixture. It should be noted that about 1% of the mixture may contain food-grade surfactants, generally from the water portion of the mixture, such as polyethylene glycol esters, oleates, alcohol ethoxylates, or others known to those skilled in the art.

The temperature of the cooling fluid is sampled in step 1007, and if found to be out of range in step 1008, a signal would be sent to a controller (not illustrated), as in step 1009, to cool the heat exchanging coil with a refrigeration unit. Step 1035 adjusts the velocity of the cooling fluid as necessary to account for changes in the cooling fluid viscosity, temperature, and the like during the chilling process. Preferably, the velocity of the cooling fluid is held constant by adjusting the force provided by one or more circulators.

Should the temperature be determined to be within the desired temperature range in step 1008, the conditioning of the solute has been completed, as in step 1111. After super-cooling as disclosed herein, the solute may be returned to its pre-chilled consistency by thawing to a temperature above 0 degrees Celsius, for example, to room temperature. There is no separation of fluid layers upon rapidly freezing the solute to −18 degrees Celsius or more once thawed. The lack of fluid layer separation is advantageous, as solubilization of the solute in subsequent cooling cycles increases after a first conditioning (cooling and thawing) cycle.

Figure 3:
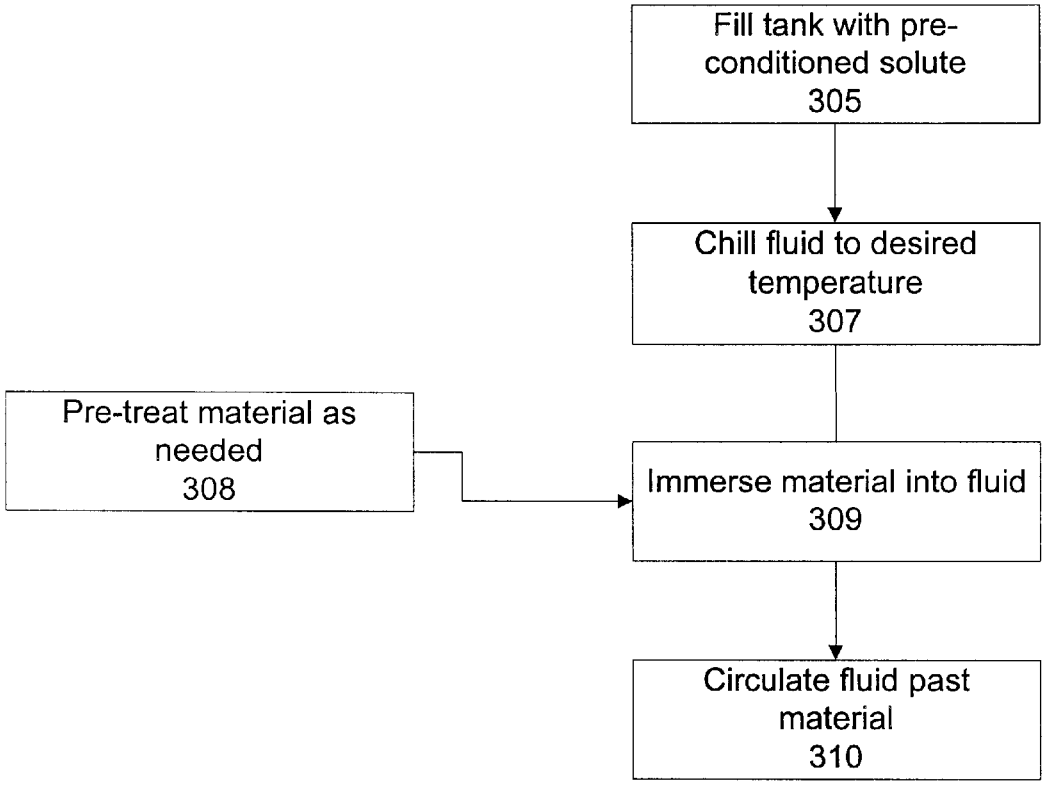
FIG. 3 is a flow diagram illustrating a method for using a pre-conditioned solute according to at least one embodiment of the present invention.

Referring now to FIG. 3, a flow diagram illustrating a method for using a preconditioned solute according to at least one embodiment of the present invention. The method commences with step 305, when a tank in a cooling apparatus is filled with solute that has been pre-conditioned as taught herein for use as a cooling fluid/heat exchange media. The pre-conditioned solute is chilled to the desired temperature in step 307. When the desired temperature for the material to be frozen is reached, material to be frozen can be immersed into the chilled pre-conditioned solute. Because the solute has been pre-conditioned prior to use, rapid rates of freezing are not as critical as when pre-conditioning a solute for the first time, and the solute will still demonstrate an enhanced heat absorption rate over non-conditioned solute.

While the pre-conditioned solute is being cooled, if necessary for certain types of material, a pre-treatment step 308 may be performed. In an embodiment, pre-conditioned solvent may be used to treat material in preparation for freezing of the material, as in step 308. Alternately, certain materials may require other chemical preparation prior to freezing. For example, chemically preparing the material may include pre-treatment of the material with agents such as stabilizers, dyes or colorants, emulsifiers, and other chemicals or chemical compounds, many of which are known to those skilled in the art. In some cases, no pre-treatment step 308 is required prior to freezing. For example, whole fryers (chickens) or whole beef rump could be directly immersed into the chilled, pre-conditioned solute in a chilling apparatus for freezing, as in step 309. In step 310, the chilled, pre-conditioned solute (cooling fluid) is circulated past the material to be frozen. According to at least one embodiment of the present invention, a substantially constant circulation of cooling fluid past the material to be frozen should be maintained in order to vitrify the material.

The steps illustrated in FIGS. 2 and 3 are shown and discussed in a sequential order. However, the illustrated method is of a nature wherein some or all of the steps are continuously performed or may be performed in a different order, and certain implicit steps may not be illustrated. For example, a temperature measurement step is not shown, however it is understood that the chilling apparatus would be such that temperature measurements could be made throughout the cycle of chilling and circulating the fluid, as was seen in FIG. 2.

In preferred embodiments, pre-conditioning a solute results in a long-duration phase change capability without a subsequent change of form. For example, it is possible to bring a solution comprised of water and a solute as disclosed herein well below the freezing point of water (super-cooled) without solidification of the solution. A solution such as the exemplary mixture presented herein is known as a eutectic mixture, that is, a mixture of two or more substances which liquefies at the lowest temperature of all such mixtures.

In a super-cooled form, pre-conditioned solute and water mixtures as disclosed herein retain liquidity, and thus become very effective "heat sinks" to rapidly absorb heat from any material in contact with the pre-conditioned solution. This altered heat absorption property occurs when a super-cooling operation is performed on the solution because a portion of the composition is held in the latent-heat super-cooled state yet does not freeze. The heat normally released on freezing of that portion is decreased by the amount of super-cooling. In an embodiment, the pre-conditioned solute has a heat absorption rate of about 135 BTU at a temperature of between about −23 degrees C. and −26 degrees C. In effect, the pre-conditioned liquid has a heat absorption rate comparable to that of solid materials such as ice. In a further embodiment, a pre-conditioned liquid, due to its altered heat absorption rate, may be used as a heat exchange medium.

In addition to increased heat absorption capabilities, the pre-conditioned solute has other advantageous capabilities. As an example, when water forms a part of a pre-conditioned solution, the super-cooled-liquid characteristics of the water in the mixture decreases the potential for freeze damage to materials undergoing freezing because of the super-cooled liquid's ability to vitrify the material. In addition, the lack of solidification of the solute enables the pre-conditioned solution to be circulated within a chilling apparatus.

Referring next to FIG. 4, a chilling apparatus suitable for use with the method is illustrated according to at least one embodiment of the present invention, and designated generally as cooling unit 800. Cooling unit 800 preferably comprises tank 810 containing cooling fluid 840. Submersed in cooling fluid 840 are circulation mechanisms 834, such as motor and impeller combinations, and heat exchanging coil 820. External to tank 810, and coupled to heat exchanging coil 820, is refrigeration unit 890.

Tank 810 may be of any dimensions necessary to immerse material to be frozen in a volume of cooling fluid 840, in which the dimensions are scaled multiples of 12 inches by 24 inches by 48 inches. Other size tanks may be employed consistent with the teachings set forth herein. For example, in one embodiment (not illustrated), tank 810 is sized to hold just enough cooling fluid 840, so containers can be placed in tank 810 for rapid freezing of suspensions including biological materials and cryoprotectants. In other embodiments, tank 810 is large enough to completely immerse entire organisms for rapid freezing. It will be appreciated that tank 810 can be made larger or smaller, as needed, to efficiently accommodate various sizes and quantities of material to be frozen.

Tank 810 holds cooling fluid 840, which serves as a primary heat exchange medium. In one embodiment, the cooling fluid is a food-grade solute. Good examples of food-grade quality fluids are those based on propylene glycol, sodium chloride solutions, glycerol, or the like. In a preferred embodiment, the cooling fluid includes the pre-conditioned solute propylene glycol. While various containers may be used to hold quantities of solute to be chilled, some embodiments of the present invention provide that cooling fluid 840 is the solute to be pre-conditioned.

In order to pre-chill solute, one embodiment of the present invention circulates cooling fluid 840 past the solute to be chilled, at a relatively constant rate of 35 liters per minute for every foot of cooling fluid contained in an area not more than 24 inches wide by 48 inches deep. The necessary circulation is provided by one or more circulation mechanisms 834 for example, a motor and impeller combination. In at least one embodiment of the present invention, submersed circulation mechanisms 834 circulate cooling fluid 840 past material to be frozen. Other circulation mechanisms 834, including various pumps (not illustrated), can be employed consistent with the objects of the present invention. At least one embodiment of the present invention increases the area and volume through which cooling fluid is circulated by employing at least one circulation mechanism 834. In embodiments using multiple circulation mechanisms 834, the area and volume of cooling fluid circulation are increased in direct proportion to each additional circulation mechanism employed. For example, in a preferred embodiment, one additional circulation mechanism is used for each foot of cooling fluid that is to be circulated through an area of not more than about 24 inches wide by 48 inches deep.

Preferably, motors within circulation mechanism 834 can be controlled to maintain a constant predetermined velocity of cooling fluid flow past the materials to be preserved, while at the same time maintaining an even distribution of cooling fluid temperature to within +/−0.5 degrees Celsius at all points within tank 810. The substantially constant predetermined velocity of cooling fluid circulating past the material or product provides a constant, measured removal of heat, which allows for the chilling or freezing of the material. In one embodiment, cooling fluid properties, such as viscosity, temperature, etc., are measured and processed, and control signals are sent to circulation mechanism 834 such that the motor within circulation mechanism 834 can increase or decrease the rotational speed or torque of impellers as needed.

In other embodiments, motors are constructed to maintain a given rotational velocity over a range of fluid conditions without producing additional heat. In such a case, the torque or rotational speed of impellers imparted by motors is not externally controlled. Of note is the fact that no external pumps, shafts, or pulleys are needed in the chilling apparatus. Combination motors and impellers, or other circulation mechanisms 834, are immersed directly in cooling fluid 840. As a result, cooling fluid 840 not only freezes material placed in tank 810, but cooling fluid 840 also provides cooling for components (i.e., motors and impellers) within circulation mechanisms 834.

Heat exchanging coil 820 is preferably a "multi-path coil," which allows refrigerant to travel through multiple paths (i.e. three or more paths), in contrast to conventional refrigeration coils in which refrigerant is generally restricted to one or two continuous paths. In addition, the coil size is in direct relationship to the cross sectional area containing the measured amount of the cooling fluid 840. For example, in a preferred embodiment, tank 810 is one foot long, two feet deep and four feet wide, and uses a heat exchanging coil 820 that is one foot by two feet. If the length of tank 810 is increased to twenty feet, then the length of heat exchanging coil 820 is also increased to twenty feet. As a result, heat exchanging coil 820 can be made approximately fifty percent of the size of a conventional coil required to handle the same heat load. Circulation mechanisms 834 circulate chilled cooling fluid 840 over material to be frozen, and then transport warmer cooling fluid to heat exchanging coil 820, which is submersed in cooling fluid 840. In at least one embodiment, heat exchanging coil 820 is so designed to remove not less than the same amount of heat from cooling fluid 840 as that removed from the material being frozen, thereby maintaining the temperature of cooling fluid 840 in a predetermined range. Heat exchanging coil 820 is connected to refrigeration unit 890, which removes the heat from heat exchanging coil 820 and the system.

In a preferred embodiment, refrigeration unit 890 is designed to match the load requirement of heat exchanging coil 820, so that heat is removed from the system in a balanced and efficient manner, resulting in the controlled, rapid freezing of a material. The efficiency of the refrigeration unit 890 is directly related to the method employed for controlling suction pressures by the efficient feeding of the heat exchange coil 820 and the efficient output of compressors used in refrigeration unit 890.

This methodology requires very close tolerances to be maintained between the refrigerant and cooling fluid 840 temperatures, and between the condensing temperature and the ambient temperature. These temperature criteria, together with the design of the heat exchange coil 820, allows heat exchange coil 820 to be fed more efficiently, which in turn allows the compressor to be fed in a balanced and tightly controlled manner to achieve in excess of twenty-five percent greater performance from the compressors than that which is accepted as the compressor manufacturer's standard rating.

Note that in the embodiment illustrated in FIG. 4, refrigeration unit 890 is an external, remotely located refrigeration system. However, in another embodiment (not illustrated), refrigeration unit 890 is incorporated into another section of tank 810. It will be appreciated that various configurations for refrigeration unit 890 may be more or less appropriate for certain configurations of cooling unit 800. For example, if tank 810 is extremely large, a separate refrigeration unit 890 may be desirable, while a portable embodiment may benefit from an integrated refrigeration unit 890. Such an integration is only made possible by the efficiencies achieved by implementing the principles as set forth herein, and particularly the use of a reduced-size heat exchanging coil.

By virtue of refrigeration unit 890 and heat exchanging coil 820, in a preferred embodiment, the cooling fluid is cooled to a temperature of between about −23° Celsius and −26° Celsius, with a temperature differential throughout the cooling fluid of less than about +/−0.5 degrees Celsius. In other embodiments, the cooling fluid is cooled to temperatures outside the −23° Celsius to −30° Celsius range in order to control the rate at which a substance is to be frozen. In an embodiment, the cooling fluid is super-cooled at an average rate of between about 6.5 degrees C. and 8.5 degrees C. per minute. In another embodiment, fluid is super-cooled at an average rate of at least about 17 degrees C. per minute. Other embodiments control the circulation rate of the cooling fluid to achieve desired freezing rates. Alternatively, the volume of cooling fluid may be changed in order to facilitate a particular freezing rate. It will be appreciated that various combinations of cooling fluid circulation rate, cooling fluid volume, and cooling fluid temperature can be used to achieve desired freezing rates.

In the preceding detailed description, reference has been made to the accompanying drawings which form a part hereof, and in which are shown by way of illustration specific embodiments in which the invention may be practiced. These embodiments have been described in sufficient detail to enable those skilled in the art to practice the invention, and it is to be understood that other embodiments may be utilized and that logical, mechanical, chemical and electrical changes may be made without departing from the spirit or scope of the invention. To avoid detail not necessary to enable those skilled in the art to practice the invention, the description omits certain information known to those skilled in the art. The preceding detailed description is, therefore, not to be taken in a limiting sense, and the scope of the present invention is defined only by the appended claims.

What is claimed is:

1. A method comprising:

super-cooling a solute to produce a pre-conditioned solute, and using the pre-conditioned solute as a heat exchange medium, wherein the step of super-cooling alters a heat absorption rate of the solute, such that the pre-conditioned solute has an increased heat absorption rate as compared to the solute prior to conditioning.

2. The method as in claim 1, wherein the step of super-cooling includes bringing the solute from room temperature to at least about −23° C. at an average rate of at least about 6.5° C. per minute to produce a pre-conditioned solute.

3. The method as in claim 1, wherein the heat absorption rate of the pre-conditioned solute is about 135 BTU at a temperature of between about −23° C. and −26° C.

4. The method as in claim 1, wherein at least a portion of the pre-conditioned solute remains in a super-cooled state after the step of super-cooling, such that the pre-conditioned solute exhibits no spike in temperature upon subsequently being cooled from room temperature to between about −23° C. and −26° C.

5. The method as in claim 1, wherein the step of super-cooling includes super-cooling the solute from room temperature to between about −23° C. and −26° C.

6. The method as in claim 1, wherein the step of super-cooling includes cooling the solute at an average rate of between about 6.5° C. and 8.5° C. per minute.

7. The method as in claim 1, wherein the step of super-cooling includes cooling the solute, for at least a portion of time, at an average rate of at least about 17° C. per minute.

8. The method as in claim 1, wherein the pre-conditioned solute includes propylene glycol.

9. The method as in claim 8, wherein the pre-conditioned solute includes:

about 50 percent water;

about 50 percent propylene glycol; and about 1 percent surfactant.

10. The method as in claim 1, wherein the pre-conditioned solute includes glycerol.

* * * * *